US011232719B1

(12) United States Patent
Kraft et al.

(10) Patent No.: US 11,232,719 B1
(45) **Date of Patent: *Jan. 25, 2022**

(54) SINGLE PLY WRISTBAND WITH PRINTABLE COATING

(71) Applicant: WARD KRAFT, INC., Fort Scott, KS (US)

(72) Inventors: Roger Kraft, Fort Scott, KS (US); Gina Staudinger, Louisburg, KS (US); Roger Davis, Garland, KS (US); Phil Quick, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/013,065

(22) Filed: Sep. 4, 2020

Related U.S. Application Data

(60) Provisional application No. 62/895,547, filed on Sep. 4, 2019.

(51) Int. Cl.

| | |
|---|---|
| ***G09F 3/00*** | (2006.01) |
| ***G09F 3/10*** | (2006.01) |
| *G09F 3/02* | (2006.01) |

(52) U.S. Cl.
CPC ..... *G09F 3/005* (2013.01); *G09F 3/10* (2013.01); *G09F 2003/0201* (2013.01); *G09F 2003/0202* (2013.01); *G09F 2003/023* (2013.01)

(58) Field of Classification Search
CPC ... G09F 3/02; G09F 3/005; G09F 3/10; G09F 2003/0277; G09F 2003/0219;
(Continued)

(56) References Cited

U.S. PATENT DOCUMENTS

| | | | |
|---|---|---|---|
| 230,455 | A | 7/1880 | Wilcox |
| 919,983 | A | 4/1909 | Walsh |

(Continued)

FOREIGN PATENT DOCUMENTS

| | | | |
|---|---|---|---|
| EP | 0996106 | A1 | 4/2000 |
| EP | 1974603 | A2 | 10/2008 |

(Continued)

OTHER PUBLICATIONS

Non-Final Office Action dated Dec. 29, 2017 issued in U.S. Appl. No. 15/339,105.

(Continued)

*Primary Examiner* — Cassandra Davis
(74) *Attorney, Agent, or Firm* — Avant Law Group, LLC

(57) ABSTRACT

A combination wristband and label form. The front side has a first portion having a plurality of labels die cut therein and a second portion having a void. A back side of the form comprises a polyester section. The form includes a single-ply wristband defined by die cuts in the polyester section. The single-ply wristband has a foldable portion comprising a first panel and a second panel. The first panel is configured to accept printed indicia. A strap extends laterally from the first panel in a first direction and a tab extends from the second panel in a second direction opposite to the first direction. The tab is configured to be adhesively adhered to the strap to secure the single-ply wristband around a person's appendage. The single-ply wristband is of unitary construction and is devoid of paper.

18 Claims, 9 Drawing Sheets

(58) Field of Classification Search
CPC ..... G09F 2003/023; G09F 2003/0201; G09F 2003/0226; G09F 3/14
See application file for complete search history.

(56) References Cited

U.S. PATENT DOCUMENTS

| | | | |
|---|---|---|---|
| 922,948 | A | 5/1909 | Portmore |
| 1,039,431 | A | 9/1912 | Moore |
| 1,383,335 | A | 7/1921 | Penksa |
| 1,517,456 | A | 12/1924 | Pulliam |
| 2,054,227 | A | 9/1936 | Nicholas |
| 2,073,280 | A | 3/1937 | Lederer |
| 2,553,676 | A | 5/1951 | Roos |
| 2,641,074 | A | 6/1953 | Richmond |
| 2,687,978 | A | 8/1954 | Vogt |
| 2,914,166 | A | 11/1959 | Bihler |
| 3,153,869 | A | 10/1964 | Twentier |
| 3,197,899 | A | 8/1965 | Twentier |
| 3,402,808 | A | 9/1968 | Yannuzzi |
| 3,517,802 | A | 6/1970 | Petrie |
| 3,585,743 | A | 6/1971 | Jeffers |
| 3,660,916 | A | 5/1972 | Mcdermott et al. |
| 3,854,229 | A | 12/1974 | Morgan |
| 4,004,362 | A | 1/1977 | Barbieri |
| 4,078,324 | A | 3/1978 | Wiebe |
| 4,138,234 | A | 2/1979 | Kubesa |
| 4,179,833 | A | 12/1979 | Knodel |
| 4,226,036 | A | 10/1980 | Krug |
| 4,233,715 | A | 11/1980 | Mcdermott |
| 4,314,415 | A | 2/1982 | De Woskin |
| 4,318,234 | A | 3/1982 | Charles et al. |
| 4,370,370 | A | 1/1983 | Iwata et al. |
| 4,565,731 | A | 1/1986 | Komatsu et al. |
| 4,612,718 | A | 9/1986 | Golub et al. |
| 4,627,994 | A | 12/1986 | Welsch |
| 4,630,384 | A | 12/1986 | Breen |
| 4,682,431 | A | 7/1987 | Kowalchuk |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | Dewoskin |
| 4,941,210 | A | 7/1990 | Konucik |
| 4,950,638 | A | 8/1990 | Yuyama et al. |
| 4,956,931 | A | 9/1990 | Selke et al. |
| D312,654 | S | 12/1990 | Giordano |
| 4,978,144 | A | 12/1990 | Schmidt et al. |
| 4,991,337 | A | 2/1991 | Solon |
| RE33,616 | E | 6/1991 | Welsch |
| 5,026,064 | A | 6/1991 | Pasfield |
| 5,045,426 | A | 9/1991 | Maierson et al. |
| 5,048,870 | A | 9/1991 | Mangini et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,331,140 | A | 7/1994 | Stephany |
| 5,351,993 | A | 10/1994 | Wright et al. |
| 5,364,133 | A | 11/1994 | Hofer et al. |
| 5,370,420 | A | 12/1994 | Khatib et al. |
| 5,381,617 | A | 1/1995 | Schwartztol et al. |
| 5,383,686 | A | 1/1995 | Laurash |
| 5,395,667 | A | 3/1995 | Ohno et al. |
| 5,401,110 | A | 3/1995 | Neeley |
| 5,418,026 | A | 5/1995 | Dronzek, Jr. et al. |
| 5,421,942 | A | 6/1995 | Hoffmann |
| 5,423,574 | A | 6/1995 | Forte-Pathroff |
| 5,427,416 | A | 6/1995 | Birch |
| 5,448,846 | A | 9/1995 | Peterson et al. |
| 5,457,906 | A | 10/1995 | Mosher, Jr. |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,562,789 | A | 10/1996 | Hoffmann |
| 5,581,924 | A | 12/1996 | Peterson |
| 5,586,788 | A | 12/1996 | Laurash |
| 5,595,404 | A | 1/1997 | Skees |
| 5,596,202 | A | 1/1997 | Arakawa |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,670,015 | A | 9/1997 | Finestone et al. |
| 5,687,903 | A | 11/1997 | Akridge et al. |
| 5,721,178 | A | 2/1998 | Lalande |
| D391,991 | S | 3/1998 | Conner |
| 5,752,722 | A | 5/1998 | Moore et al. |
| 5,765,885 | A | 6/1998 | Netto |
| 5,785,354 | A | 7/1998 | Haas |
| 5,837,337 | A | 11/1998 | Schnitzer |
| 5,837,341 | A | 11/1998 | Johnstone |
| 5,840,143 | A | 11/1998 | Swanson |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A * | 1/2000 | Attia ..... B42D 15/00 156/289 |
| D423,044 | S | 4/2000 | Burke et al. |
| 6,053,535 | A | 4/2000 | Washburn et al. |
| 6,055,756 | A | 5/2000 | Aoki |
| 6,058,639 | A | 5/2000 | Tinklenberg et al. |
| 6,067,739 | A | 5/2000 | Riley |
| 6,071,585 | A | 6/2000 | Roth |
| 6,092,321 | A | 7/2000 | Cheng |
| 6,108,876 | A | 8/2000 | Hubbert |
| 6,155,476 | A | 12/2000 | Fabel |
| 6,155,603 | A | 12/2000 | Fox |
| 6,159,570 | A | 12/2000 | Ulrich et al. |
| 6,199,730 | B1 | 3/2001 | Chisolm |
| D448,404 | S | 9/2001 | Hamilton et al. |
| 6,303,639 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,364,366 | B1 | 4/2002 | Schwartz |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| D473,264 | S | 4/2003 | Sanford et al. |
| 6,611,962 | B2 | 9/2003 | Redwood et al. |
| 6,641,048 | B1 | 11/2003 | Schintz et al. |
| 6,685,228 | B2 | 2/2004 | Riley |
| 6,748,687 | B2 | 6/2004 | Riley |
| 6,782,648 | B1 | 8/2004 | Mosher, Jr. |
| 6,807,680 | B2 | 10/2004 | Sloot |
| 6,836,215 | B1 | 12/2004 | Laurash et al. |
| 6,844,041 | B2 | 1/2005 | Squier et al. |
| D503,197 | S | 3/2005 | Stewart et al. |
| 6,863,311 | B2 | 3/2005 | Riley |
| 6,971,200 | B2 | 12/2005 | Valenti, Jr. |
| 6,981,948 | B2 | 1/2006 | Pellegrino et al. |
| 7,017,293 | B2 | 3/2006 | Riley |
| 7,017,294 | B2 | 3/2006 | Riley |
| D521,565 | S | 5/2006 | Stewart et al. |
| 7,047,682 | B2 | 5/2006 | Riley |
| 7,197,842 | B2 | 4/2007 | Ali |
| 7,222,448 | B2 | 5/2007 | Riley |

(56) References Cited

U.S. PATENT DOCUMENTS

| | | | | |
|---|---|---|---|---|
| 7,240,446 | B2 | 7/2007 | Bekker | |
| 7,286,055 | B2 | 10/2007 | Girvin et al. | |
| 7,325,347 | B2 | 2/2008 | Riley | |
| 7,386,949 | B2 | 6/2008 | Riley | |
| 7,454,854 | B2 | 11/2008 | Riley | |
| 7,461,473 | B2 | 12/2008 | Riley | |
| 7,520,077 | B2 | 4/2009 | Riley | |
| 7,523,576 | B1 | 4/2009 | Petty | |
| 7,654,024 | B2 | 2/2010 | Riley | |
| 7,658,026 | B2 | 2/2010 | Jain | |
| 7,658,027 | B2 | 2/2010 | Jain | |
| D611,984 | S | 3/2010 | Ali et al. | |
| 7,753,344 | B1 | 7/2010 | Riley et al. | |
| 7,779,569 | B2 * | 8/2010 | Riley | G09F 3/0288 40/633 |
| 7,779,570 | B2 | 8/2010 | Riley | |
| 7,779,669 | B2 | 8/2010 | Riley et al. | |
| 7,784,209 | B2 | 8/2010 | Greer | |
| 7,784,210 | B2 | 8/2010 | Riley et al. | |
| 7,818,908 | B2 | 10/2010 | Greer | |
| 7,823,310 | B2 | 11/2010 | Jain et al. | |
| 7,877,915 | B2 | 2/2011 | Jain et al. | |
| 7,883,018 | B2 | 2/2011 | Riley et al. | |
| 7,918,045 | B2 | 4/2011 | Riley | |
| D640,738 | S | 6/2011 | Jain | |
| 7,967,340 | B2 | 6/2011 | Hofer | |
| 8,006,422 | B2 | 8/2011 | Riley | |
| 8,011,125 | B2 | 9/2011 | Riley et al. | |
| 8,042,283 | B2 | 10/2011 | Bennett | |
| 8,074,389 | B2 | 12/2011 | Greer | |
| 8,099,888 | B2 | 1/2012 | Riley | |
| 8,109,021 | B2 | 2/2012 | Jain | |
| 8,424,115 | B2 | 4/2013 | Greer | |
| 8,776,417 | B2 | 7/2014 | Jain | |
| 8,844,972 | B2 | 9/2014 | Riley | |
| 8,904,686 | B2 | 12/2014 | Greer | |
| 9,114,187 | B2 | 8/2015 | Hofer | |
| 10,207,020 | B2 | 2/2019 | Hofer | |
| 10,997,874 | B1 * | 5/2021 | Kraft | G09F 3/005 |
| 2002/0152928 | A1 | 10/2002 | Lawandy et al. | |
| 2002/0176973 | A1 | 11/2002 | Keiser | |
| 2003/0001381 | A1 | 1/2003 | Riley | |
| 2003/0003249 | A1 | 1/2003 | Benim et al. | |
| 2003/0011190 | A1 | 1/2003 | Ryan | |
| 2004/0060216 | A1 | 4/2004 | Riley | |
| 2004/0068906 | A1 | 4/2004 | Riley | |
| 2004/0128892 | A1 | 7/2004 | Valenti, Jr. | |
| 2004/0148836 | A1 | 8/2004 | Riley | |
| 2004/0244251 | A1 | 12/2004 | Riley | |
| 2005/0091896 | A1 | 5/2005 | Kotik et al. | |
| 2005/0108912 | A1 | 5/2005 | Bekker | |
| 2005/0279001 | A1 | 12/2005 | Riley | |
| 2005/0281989 | A1 | 12/2005 | Finger | |
| 2006/0230661 | A1 | 10/2006 | Bekker | |
| 2006/0236578 | A1 | 10/2006 | Saint et al. | |
| 2006/0242875 | A1 | 11/2006 | Wilson et al. | |
| 2006/0261958 | A1 | 11/2006 | Klein | |
| 2007/0089342 | A1 | 4/2007 | Jain et al. | |
| 2007/0120358 | A1 | 5/2007 | Waggoner et al. | |
| 2007/0243361 | A1 | 10/2007 | Riley et al. | |
| 2007/0257113 | A1 | 11/2007 | Davis et al. | |
| 2008/0098636 | A1 | 5/2008 | Greer | |
| 2008/0250688 | A1 * | 10/2008 | Greer | G09F 3/005 40/633 |
| 2009/0031602 | A1 | 2/2009 | Riley | |
| 2009/0094872 | A1 | 4/2009 | Ali et al. | |
| 2009/0094873 | A1 | 4/2009 | Riley | |
| 2009/0193701 | A1 | 8/2009 | Greer | |
| 2009/0277061 | A1 | 11/2009 | Jain et al. | |
| 2009/0282717 | A1 | 11/2009 | Jain et al. | |
| 2010/0071241 | A1 | 3/2010 | Jain et al. | |
| 2010/0253060 | A1 | 10/2010 | Riley et al. | |
| 2010/0281724 | A1 * | 11/2010 | Greer | A61B 90/96 40/633 |
| 2011/0042933 | A1 | 2/2011 | Landsman et al. | |
| 2012/0210620 | A1 | 8/2012 | Jain et al. | |
| 2013/0056974 | A1 | 3/2013 | Jain et al. | |

FOREIGN PATENT DOCUMENTS

| | | | |
|---|---|---|---|
| EP | 2806594 | A1 | 11/2014 |
| FR | 960859 | A | 4/1950 |
| GB | 2045718 | A | 11/1980 |
| GB | 2160492 | A | 12/1985 |
| GB | 2228915 | A | 9/1990 |
| JP | 08190350 | A | 7/1996 |
| JP | 08299035 | A | 11/1996 |
| JP | 3032299 | U | 12/1996 |
| JP | 10207374 | A | 8/1998 |
| JP | 11015383 | A | 1/1999 |
| JP | 2001316921 | A | 1/2001 |
| JP | 2002117190 | A | 4/2002 |
| JP | 2002351321 | A | 12/2002 |
| JP | 2003066849 | A | 3/2003 |
| JP | 2003157010 | A | 5/2003 |
| JP | 2003164307 | A | 6/2003 |
| JP | 2006039209 | A | 2/2006 |
| WO | 9612618 | A1 | 5/1996 |
| WO | 9823081 | A1 | 5/1998 |
| WO | 9918817 | A1 | 4/1999 |
| WO | 0239412 | A2 | 6/2002 |
| WO | 03003331 | A2 | 1/2003 |
| WO | 2004028826 | A2 | 4/2004 |
| WO | 2005064574 | A1 | 7/2005 |
| WO | 2006007356 | A1 | 1/2006 |
| WO | 2007021375 | A2 | 2/2007 |
| WO | 2007133906 | A2 | 11/2007 |
| WO | 2008079952 | A2 | 7/2008 |
| WO | 2009099787 | A1 | 8/2009 |
| WO | 2009137195 | A1 | 11/2009 |
| WO | 2010129131 | A1 | 11/2010 |

OTHER PUBLICATIONS

Non-Final Office Action dated Jan. 6, 2021 issued in U.S. Appl. No. 17/013,065.

Notice of Allowance dated Jan. 11, 2021 issued in U.S. Appl. No. 16/418,723.

* cited by examiner

SINGLE PLY WRISTBAND WITH PRINTABLE COATING

RELATED APPLICATIONS

This application claims priority to U.S. Provisional Application No. 62/895,547, filed on Sep. 4, 2019. This application is also a continuation-in-part of U.S. patent application Ser. No. 16/418,723, filed May 21, which is a continuation-in-part of U.S. patent application Ser. No. 15/403,922, filed Jan. 11, 2017, and which is a continuation of, and claims priority to, U.S. patent application Ser. No. 15/339,105, filed Oct. 31, 2016, which granted as U.S. Pat. No. 10,249,221. The '105 Application claims priority to U.S. Provisional Application No. 62/247,863, filed on Oct. 29, 2015, U.S. Provisional Application No. 62/256,465, filed on Nov. 17, 2015, and U.S. Provisional Patent Application No. 62/257,086, filed on Nov. 18, 2015. The disclosures of each of these applications are incorporated by reference in their entireties herein.

FIELD OF THE DISCLOSURE

The disclosure relates generally to the field of wristbands. More specifically, the disclosure relates to single ply wristbands and to methods of making and using same.

BACKGROUND

The wristband is a frequently-used instrument for distinguishing among various groups of people. For example, wristbands may be used to identify persons in short term healthcare facilities, or to distinguish between levels of access (e.g., at a concert) or permissions. Prior art wristbands often have disadvantages. For instance, some wristbands include a paper layer which is not water resistant causing the wristband to become torn and tattered. Other wristbands have mechanisms to laminate the paper layer, but the paper may undesirably add to the thickness of the wristband, make the wristband uncomfortable to wear, and/or increase manufacturing costs.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an embodiment, a combination wristband and label form comprises a front side formed of paper. The front side has a first portion having a plurality of labels die cut therein, and a second portion having a void. A back side of the form comprises a polyester section. The form includes a single-ply wristband defined by die cuts in the polyester section. The single-ply wristband has a foldable portion comprising a first panel and a second panel. The first panel is configured to accept printed indicia. A strap extends laterally from the first panel in a first direction and a rounded tab extends from the second panel in a second direction opposite to the first direction. The rounded tab is configured to be adhesively adhered to the strap to secure the single-ply wristband around a person's appendage. The single-ply wristband is removably secured to the combination wristband and label form to allow for the indicia to be printed by a printer on the first panel through the void. Upon folding of the foldable portion, the indicia is sandwiched between the first panel and the second panel. The single-ply wristband is of unitary construction and is devoid of paper.

In another embodiment, a combination wristband and label form comprises a front side formed of paper. The front side has a first portion having a plurality of labels die cut therein, and a second portion having a void. A back side of the form comprises a polyester section. The form includes a single-ply wristband defined by die cuts in the polyester section. The single-ply wristband has a foldable portion comprising a first panel and a second panel. The first panel is configured to accept printed indicia. A strap extends laterally from the first panel or the second panel in a first direction and a rounded tab extends from the other of the first panel and the second panel in a second direction opposite to the first direction. The rounded tab is configured to be adhesively adhered to the strap to secure the single-ply wristband around a person's appendage. The single-ply wristband is removably secured to the combination wristband and label form to allow for the indicia to be printed by a printer on the first panel through the void. Upon folding of the foldable portion, the indicia is sandwiched between the first panel and the second panel.

In yet another embodiment, a combination wristband and label form comprises a front side formed of paper. The front side has a first portion having a plurality of labels die cut therein, and a second portion having a void. A back side of the form comprises a polyester section. The form includes a single-ply wristband defined by die cuts in the polyester section. The single-ply wristband has a foldable portion comprising a first panel and a second panel. The first panel is configured to accept printed indicia. A strap extends laterally from the first panel in a first direction and a tab extends from the second panel in a second direction opposite to the first direction. The tab is configured to be adhesively adhered to the strap to secure the single-ply wristband around a person's appendage. The single-ply wristband is removably secured to the combination wristband and label form to allow for the indicia to be printed by a printer on the first panel through the void. Upon folding of the foldable portion, the indicia is sandwiched between the first panel and the second panel.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

Business forms comprising one or more wristbands die cut therein are known in the art. Such wristbands are shown, for example, in U.S. Pat. No. 7,017,294. These wristbands have a paper layer that is laminated with panels of a lamination ply after the wristband is removed from the business form. The wristband disclosed herein is formed from a solitary ply. The wristband is devoid of paper.

Figure 1:
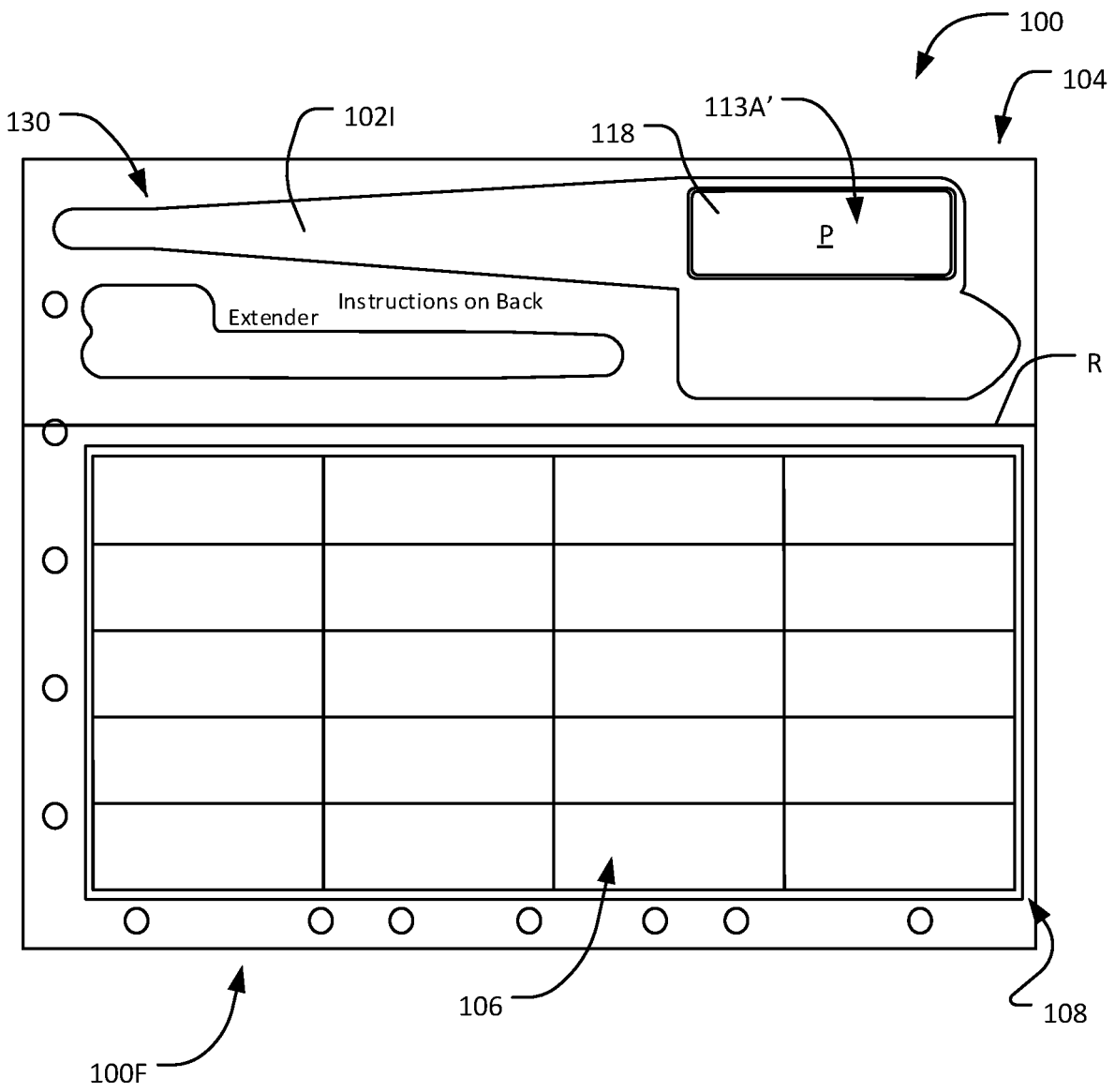
FIG. 1 shows a front view of a business form having a single ply wristband, according to an embodiment.
Figure 2:
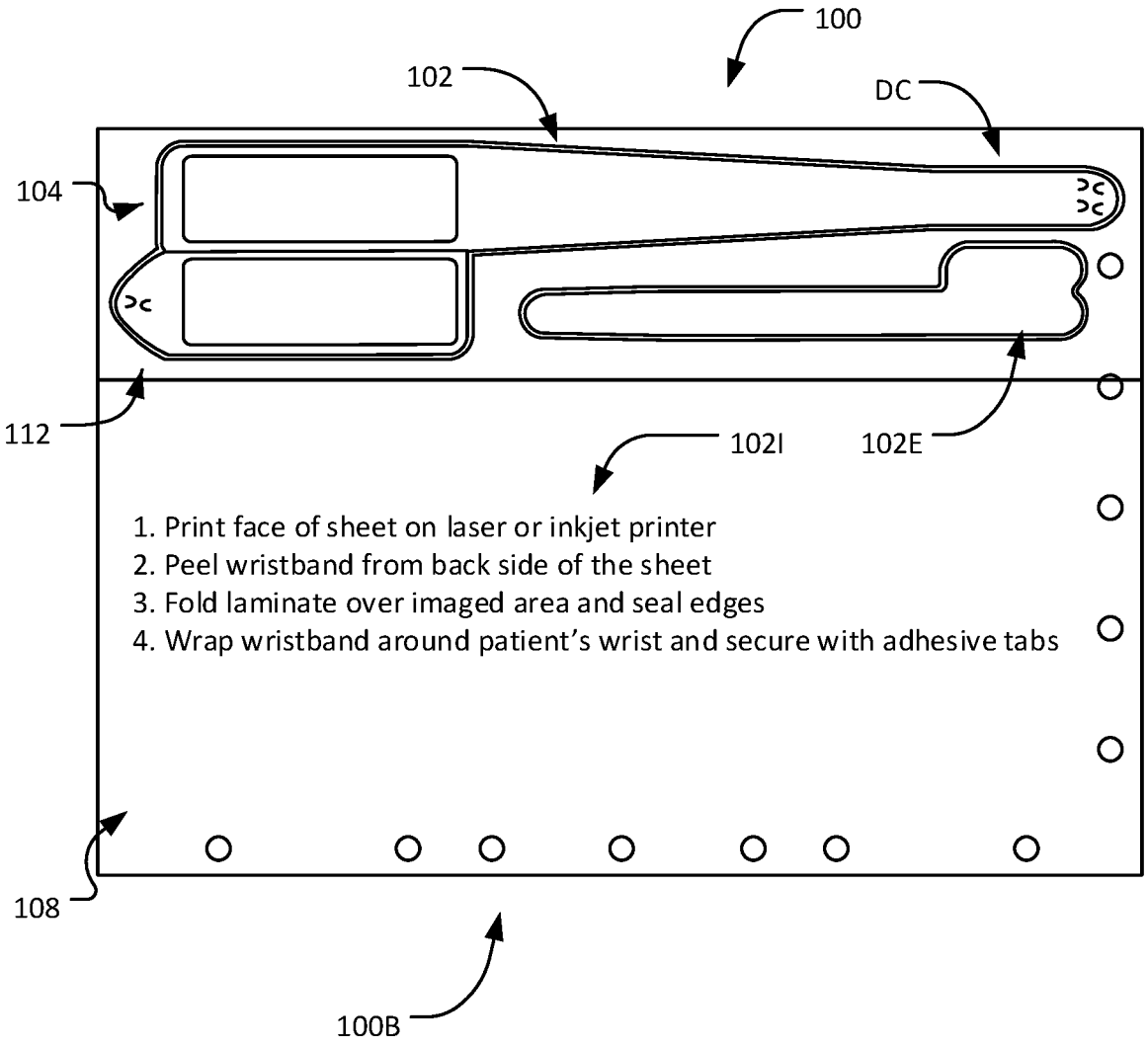
FIG. 2 shows the back side of the business form of FIG. 1.
Figure 3:
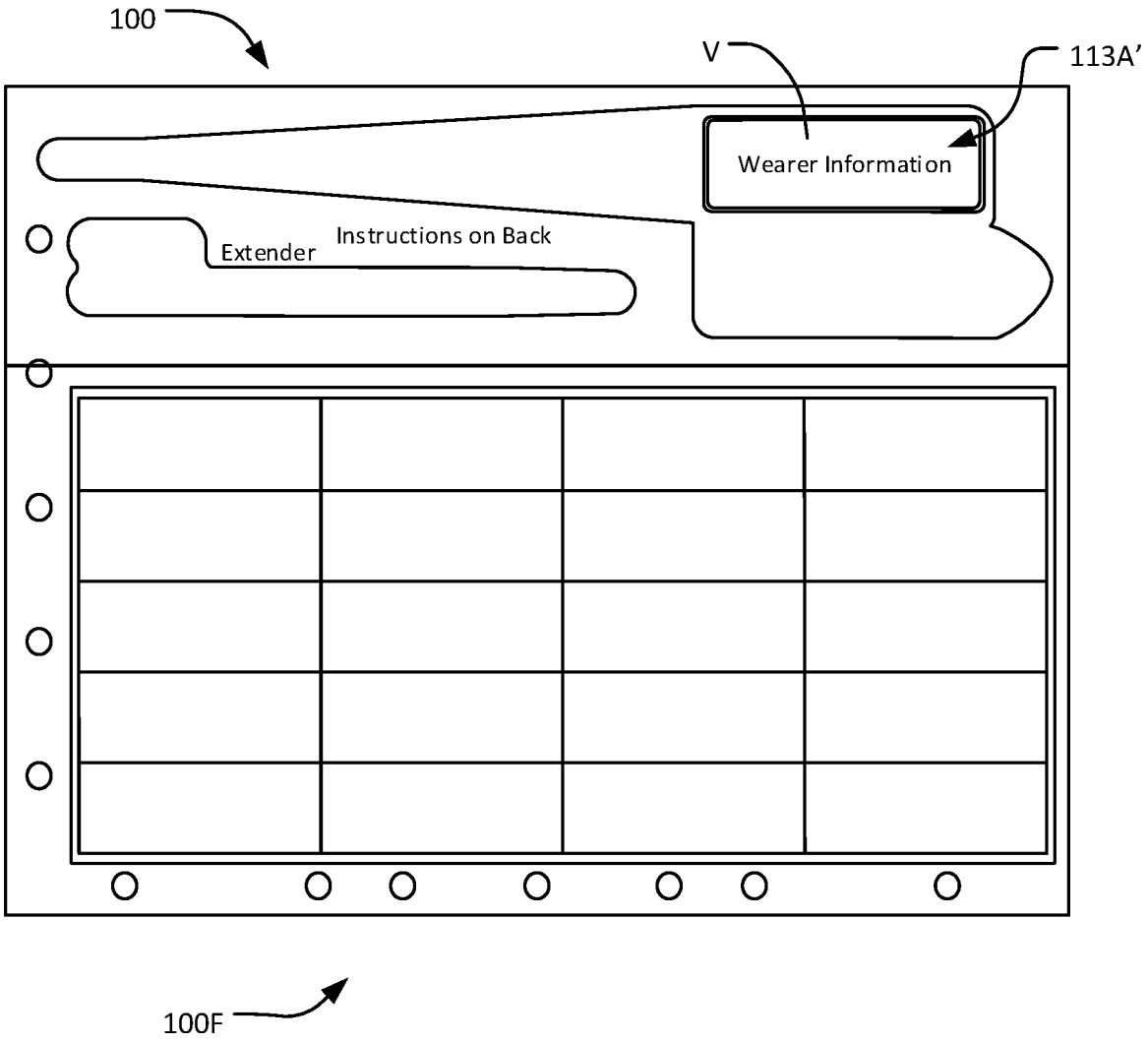
FIG. 3 shows variable indicia on a printable portion of a folding area of the single ply wristband.

FIGS. 1-3 and 6 show a business form 100, in an embodiment. The form 100 has a front side 100F (FIG. 1) and a back side 100B (FIG. 2). A wristband 102 is provided in a wristband area 104 of the form 100 on the back side 100B of the form 100. The form 100 also has a plurality of labels 106 provided in a label area 108 (see FIG. 1).

The wristband area 104 of the form 100, at the front side 100F, may comprise a paper or other printable material (the wristband area 104 also has a void portion, as discussed herein). The label area 108, at the form front side 100F, may likewise comprise paper or other suitable materials and include face stock of one or more labels 106. In embodiments, the wristband area 104 and the label area 108 may be two distinct sections of the form 100 (e.g., may be separated using perforations R (FIG. 1), may be visually separated using markings on the front side 100F and/or the back side 100B, et cetera). The labels 106 may be configured for printing (e.g., via a printable coating) and may be removable from the form 100 for selective adherence to a substrate. In embodiments, the wristband area 104 and the label area 108 at the form front side 100F may be formed of a solitary paper ply.

The form 100 may comprise printed indicia 1021. The printed indicia 1021 may be preprinted (e.g., by the manufacturer) and may comprise instructions for using the form 100 on the back side 100B, a representation of the wristband 102 on the front side 100F, et cetera. As discussed herein, the wristband 102 may also comprise printed matter which is selectively applied thereto.

At the back side 100B, the label area 108 may comprise a liner ply to which the labels 106 are removably adhered. The wristband area 104, at the back side 100B, may comprise a ply formed of polyester or other suitable synthetic material(s) (collectively herein, "polyester"). The back side 100B of the wristband area 104 may be referred to herein as the polyester section 112. The wristband 102 may be formed in the polyester ply and may be defined in the polyester section 112 using die cuts DC. In embodiments, the wristband area 104 may also include an extender 102E, which may also be defined in the polyester section 112 using die cuts. The extender 102E may be usable to extend a length of the wristband 102. In embodiments, an extender may be omitted from the form 100. Printed matter and variable indicia may be provided on the wristband 102 of the polyester section 112 as discussed herein. The polyester section 112 may otherwise be generally transparent or translucent.

Figure 4:
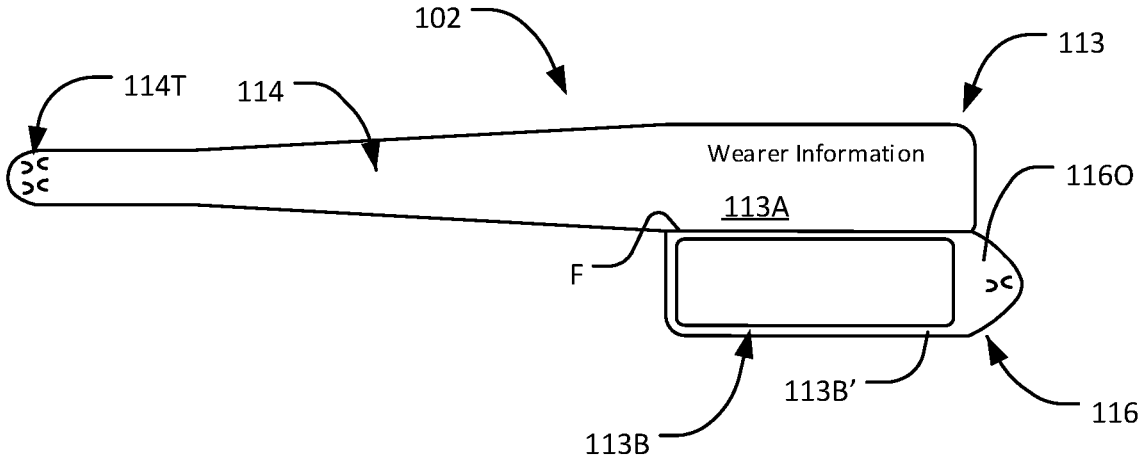
FIG. 4 shows the single ply wristband, with the variable indicia of FIG. 3 thereon, after the wristband is removed from the form of FIG. 1.

Looking now at FIG. 4, the wristband 102, which as noted is on the back side 100B of the form 100, may include a foldable area 113 having two panels 113A and 113B that may be folded along a fold line F. The panels 113A and 113B may have the same size and/or may be similarly sized. One of the panels, e.g., panel 113A, may be configured to receive printed variable indicia, whereas the other panel, e.g., panel 113B, may be generally transparent or translucent in whole or in part. In some embodiments, at the back side 100B, a perimeter portion 113B' of one panel (e.g., panel 113B) may comprise printed matter to give the panel 113B a picture frame appearance. In embodiments, each panel 113A and 113B may have a printed perimeter portion.

A strap 114 may extend generally laterally from the foldable area 113, e.g., from one of the panels 113A and 113B. In embodiments, all or part of the strap 114 may have a width that decreases with increasing distance from the foldable area 113. In other embodiments, the strap 114 may have a generally constant width. The length of each of the panels 113A, 113B may be substantially shorter than the length (e.g., one half the length, one third the length, one quarter the length, etc.) of the strap 114.

The strap 114 may comprise printed matter. In embodiments, the strap 114 may include printed matter of two or more colors. Alternately or in addition, only certain portions of the strap 114 may include printed matter whereas the other portions thereof may be devoid of printed matter or include different types of printed matter. For example, as shown in FIG. 4, a tip 114T of the strap 114 may appear visually distinct from the remainder of the strap 114. In embodiments, the tip 114T may have a rounded shape (e.g., the tip 114 may be a rounded tip).

A protruding portion 116 may also protrude generally laterally from the foldable area 113. In an embodiment, the protruding portion 116 may protrude from one of the panels 113A, 113B in one direction and the strap 114 may extend from the other of the panels 113A, 113B in the opposite direction. For example, in the embodiment illustrated in FIG. 4, the strap 114 extends from panel 113A in one direction and the protruding portion 116 protrudes from panel 113B in the opposite direction. The protruding portion 116 may have a symmetrical or nonsymmetrical shape. In embodiments, the protruding portion 116 may be a generally rounded tab (e.g., the protruding portion 116 may have a semi-circular, or generally semi-circular or frusto-circular outer surface 1160), and the length of the protruding portion 116 may be substantially shorter than the length of the strap 114. A protruding portion 116 having a generally rounded shape may preclude the wristband 102 from uncomfortably digging into a wearer's wrist when worn. In embodiments, the length of the protruding portion 116 may also be substantially shorter than the length (e.g., less than half the length) of each of the panels 113A, 113B. In operation, the protruding portion 116 may provide an area where the strap 114 may be secured without undue interference of the panels 113A, 113B. That is, the wristband 102 may be secured to a wearer via securing the strap 114 to the protruding portion 116 such that indicia located on the panels 113A, 113B is unblocked and available for viewing. While the figures show a full size wristband 102 sized to be worn by an adult, the artisan will understand the wristband 102 may be sized for a child or an infant.

The wristband 102, once removed from the form 100, has no paper. Rather, indicia is printed directly on the polyester forming the wristband, and specifically, on one of the panels (e.g., on panel 113A) of the foldable area 113 that is configured to be printable. In embodiments, indicia may be printed on the protruding portion 116 to indicate a desirable location for where a user may apply the strap 114 to secure the wristband 102 to a wearer. The wristband 102 may, in embodiments, be made from a different material than the rest of the form back side 100B. For example, the form back side 100B may be made of a release liner material, and the wristband 102 may be made of polyester or plastic.

Figure 1A:
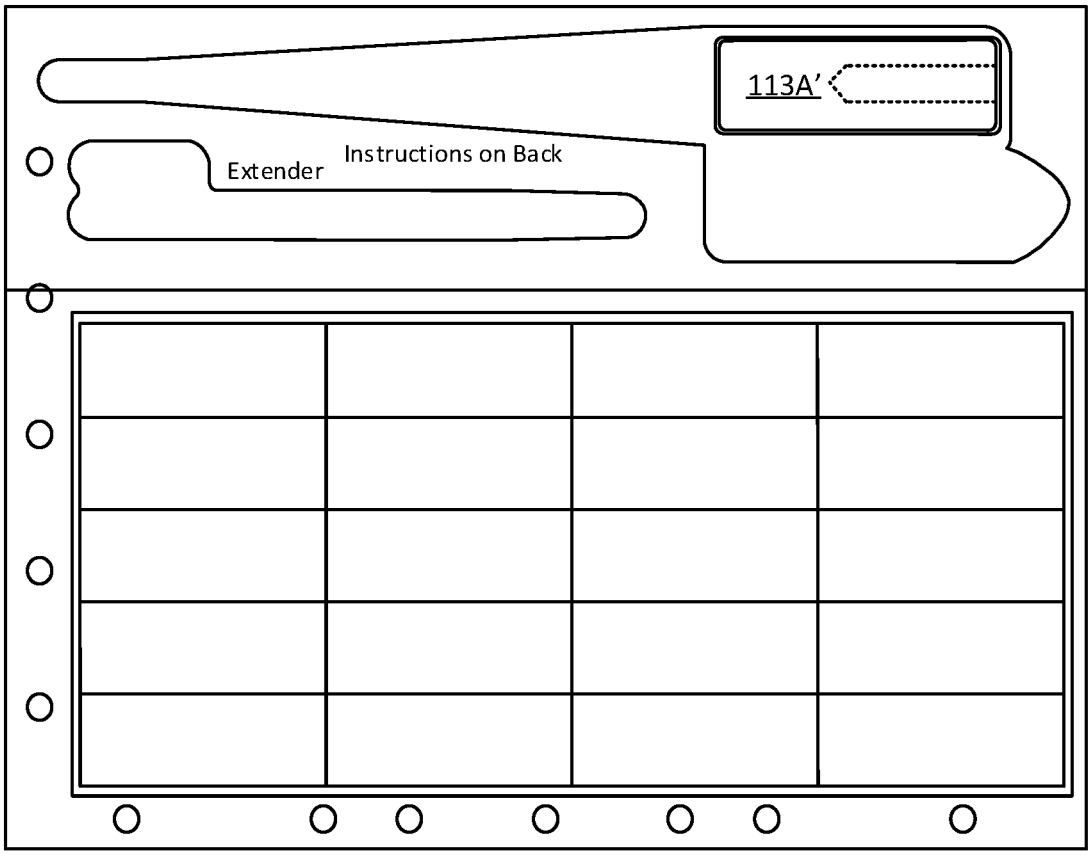
FIG. 1A shows a front view of a portion of the business form of FIG. 1 with an object situated beneath a back side of the business form.
Figure 6:
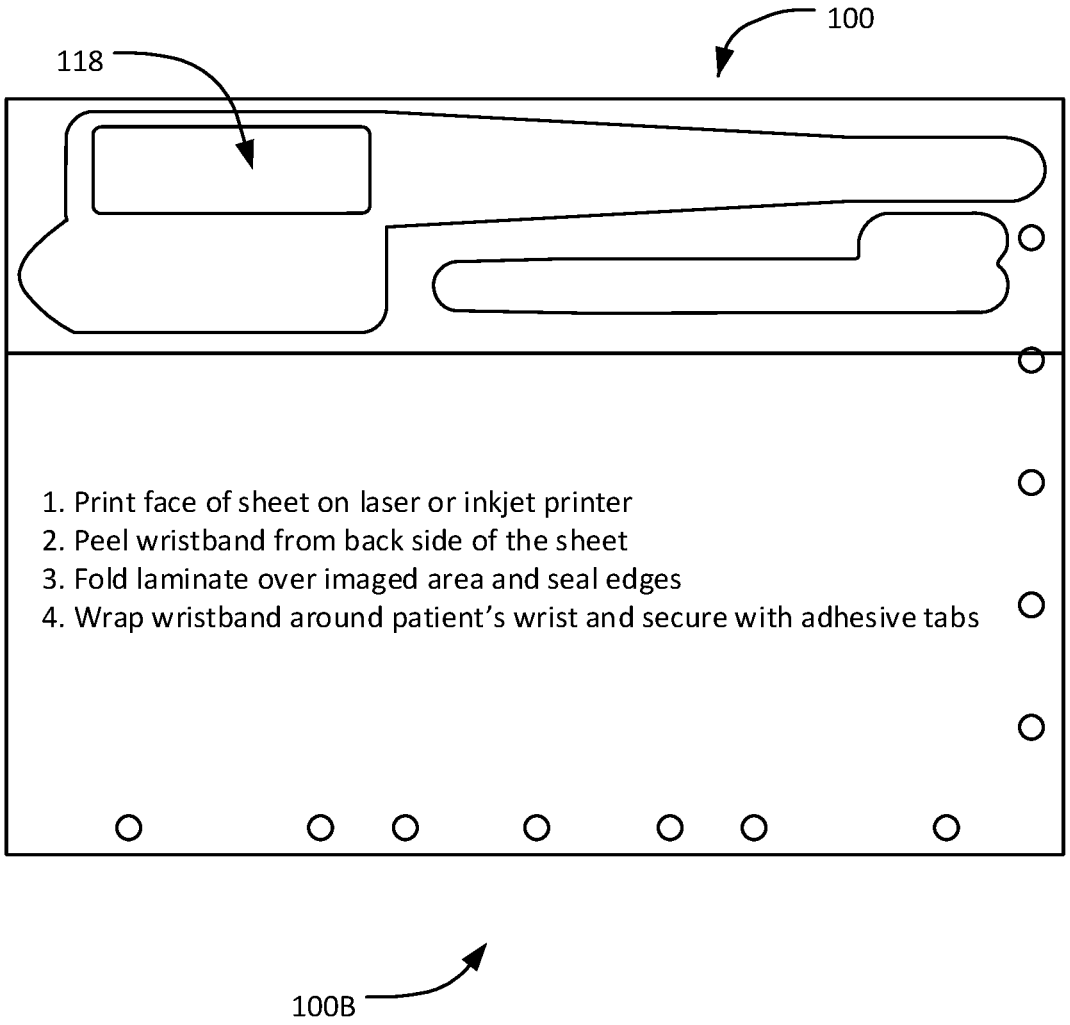
FIG. 6 shows the form of FIG. 1 with the wristband removed.

FIG. 6 shows the back side 100B of the form 100 with the wristband 102 removed. As can be seen, the paper section 130 (FIG. 1) of the wristband area 104 at the front side 100F of the form 100 may include a void 118 (see also FIG. 6) corresponding to all or part of one of the panels 113A, 113B, and this void extends through the form 100 when the wristband 100 is removed. Thus, as shown in FIG. 1, while the wristband 102 is removably coupled to the form 100, the void 118 may expose panel 113A (FIG. 4) of the wristband 102, and specifically, a portion 113A' thereof that faces away from the form back side 100B. The exposed portion 113A' may, in embodiments, include printable substance P. For example, the exposed portion 113A' may include a printable substance P that is white. In some embodiments, the printable substance P may be of a different color. The printable substance P may be, e.g., ink. Alternately or additionally, the printable substance P may be a printable coating. The printable substance P may allow for the form 100 to be passed through a printer such that the printing device (e.g., print head) faces the form front side 100F and indicia is printed directly onto the panel 113A, and specifically, on the exposed portion 113A' thereof, through the void 118. In the prior art, conversely, variable indicia is printed on a paper section of the wristband that is accessible at the front side of the form through the void. Thus, as can be seen in FIG. 1A, the exposed portion of the disclosed form 100 does not have associated therewith a paper portion. An object, a writing utensil in this example, placed underneath the exposed portion 113A' on the form back side 100B is generally visible through the void 118 and the polyester/printable substance P (e.g., ink) from the form front side 100F while the wristband 102 is coupled to the form 100.

Printed indicia 1021 on the form back side (see FIG. 2) and/or the form front side 100F, including the indicia on the wristband 102, may be preprinted—except for the variable indicia that is printed on the exposed portion 113A' from the form front side 100F. A user may print variable information on the exposed portion 113A' through the void 118 when the wristband 102 is ready for use (e.g., where the form 100 is being used by a hospital for a patient, the hospital staff may pass the form 100 through the printer to print the patient name and/or other information (e.g., machine readable code, medication name, et cetera) on the exposed portion 113A'). For example, while not required, wearer information or other variable indicia V (FIG. 3) may be printed on the exposed portion through the void 118 (e.g., using a printer). The wristband 102 may thereafter be uncoupled from the form 100 for use and be configured on the wearer.

Figure 7:
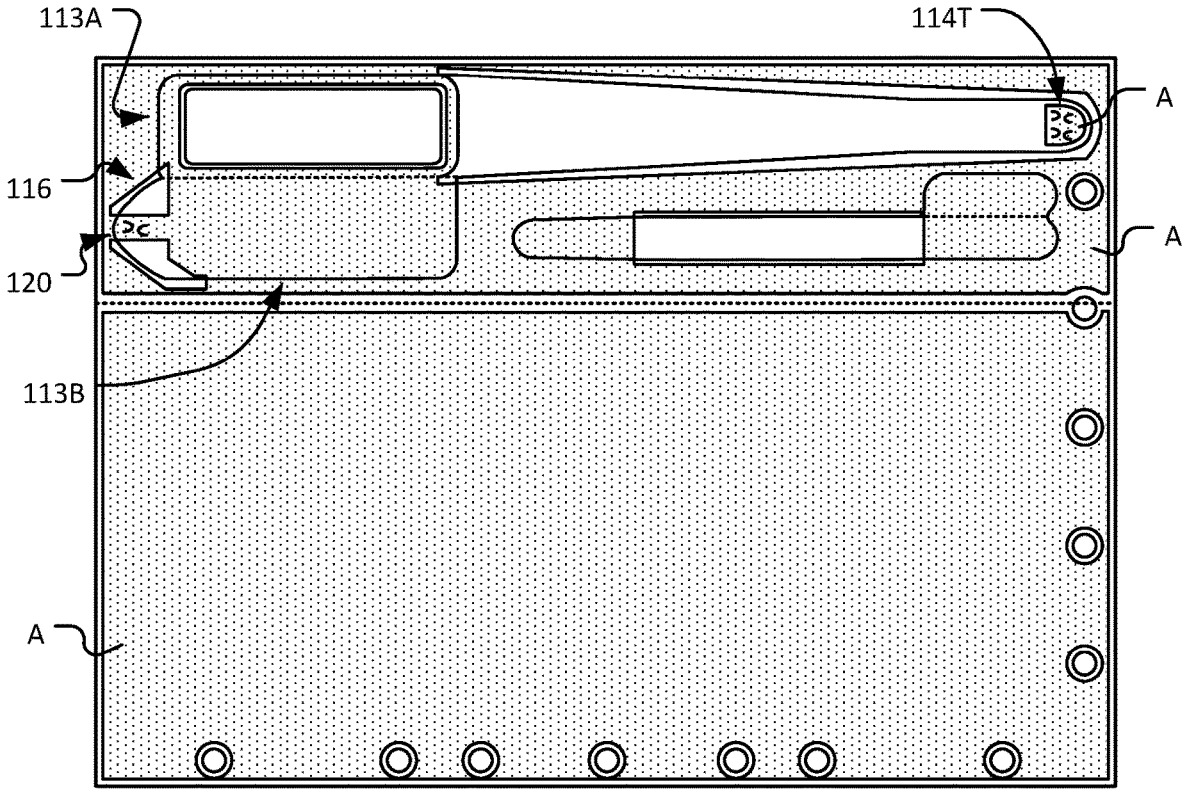
FIG. 7 shows areas of the business form of FIG. 1 comprising adhesive.
Figure 8:
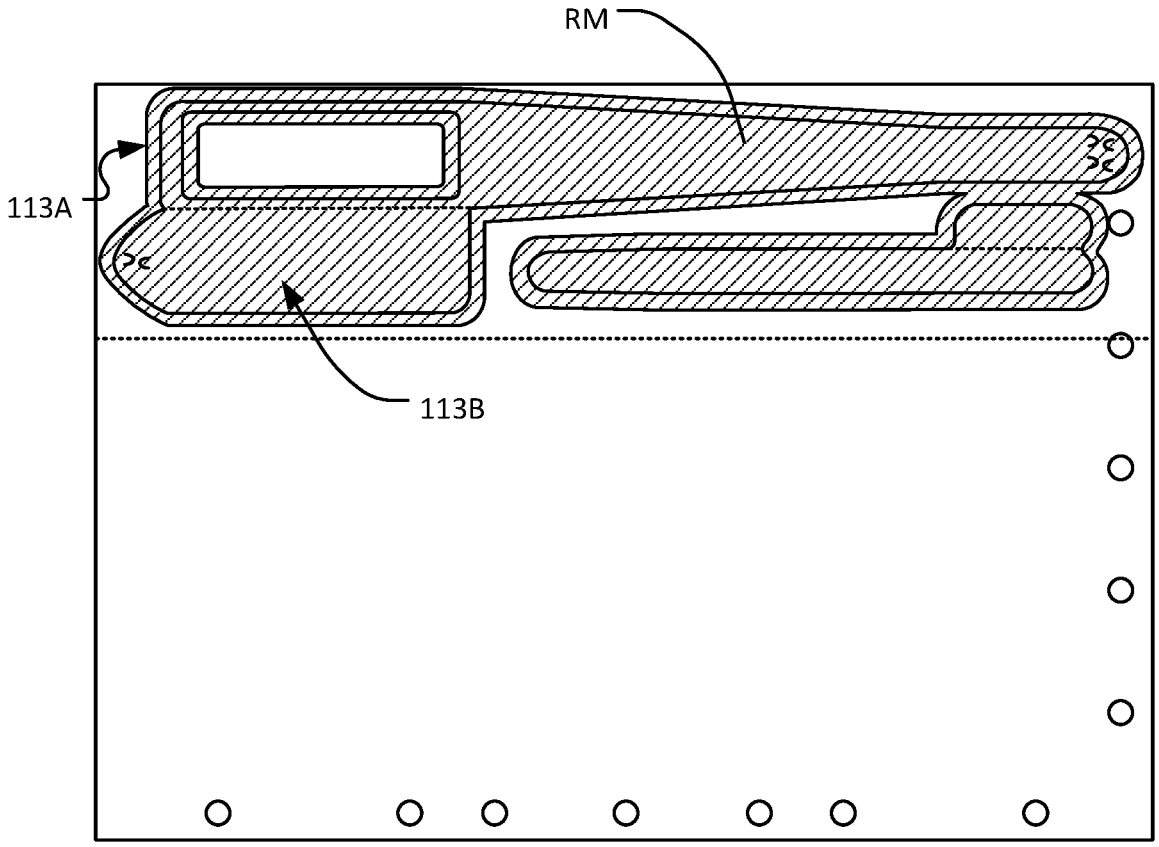
FIG. 8 shows areas of the business form of FIG. 1 comprising a release material.

The wristband 102 may be removed from the form 100 for use along the die cuts DC from the back side 100B in one smooth motion. To illustrate, attention is directed to FIGS. 7 and 8, which respectively show the placement of adhesive A and release material RM that is selectively applied to the form 100 to allow the wristband 102 to be removably coupled to the form 100. The artisan will understand the placement of the adhesive A and the release material RM in the figures is merely exemplary and is not intended to be independently limiting.

Specifically, adhesive A may be provided on a portion of the tip 114T and on the panel 113B, and release material RM may correspondingly be provided on these areas to allow the wristband 102 to be selectively secured to the form 100 and removed therefrom. All or part of the strap 114, however, may be devoid of adhesive A (and similarly, the strap of the extender 102E may be devoid of adhesive A). The user may therefore place his finger under the strap 114 at the form back side 100B and easily peel the wristband 102 from the form 100 in one smooth motion. Alternately, the user may hold the wristband 102 from another location and peel the wristband 102 from the form back side 100B for use. The exposed portion 113A' (which is on the front side of form 100 while the wristband 102 is coupled thereto) may also be devoid of adhesive A, to ensure that indicia may be printed thereon by the printer without the printer contacting any adhesive A on the form 100. Further, the lack of adhesive A on various portions of the wristband 102 may ensure that the wristband 102 does not inadvertently stick to the wrist of the patient or other wearer.

Figure 5:
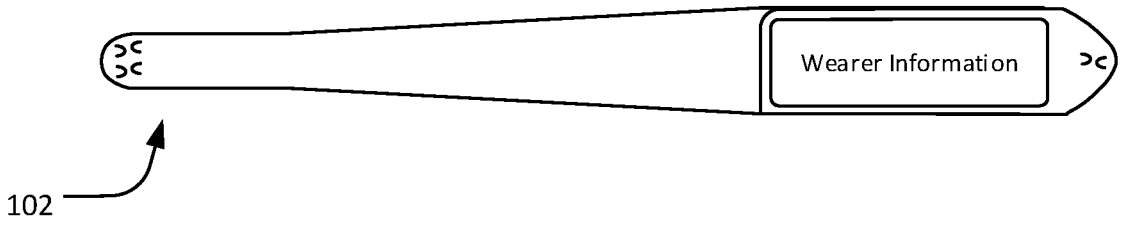
FIG. 5 shows the single ply wristband with the printable portion being laminated using a panel of a foldable area.

Once variable indicia is printed on the exposed portion 113A' through the void and the wristband 102 is peeled from the form 100 from the back side 100B, the panels 113A, 113B of the foldable area 113 may be folded along the fold line F to cover the exposed panel 113A, thus laminating the variable indicia printed thereon (see FIG. 5). Specifically, the printable substance P (e.g., ink) is situated on the front side of the panel 113A (and in embodiments, also on one or more other portions of the wristband except for the panel 113B), and after the wristband 102 is removed, the panel 113B may be folded such that the panel 113B is in front of the variable indicia V printed on the exposed portion 113A'. The variable indicia V may therefore be sandwiched by the panels 113A and 113B. As noted, printed matter may be provided only on the perimeter portion 113B' of the panel 113B whereas the remainder thereof may be generally transparent. Thus, the variable indicia V printed on the printable substance P on the exposed portion 113A' of the panel 113A may be readily viewable through the panel 113B. In embodiments, the printable substance P, e.g., ink, may be omitted from the panels 113A and/or 113B and variable indicia may be printed directly on the transparent polyester. In other embodiments, the variable indicia V may be printed on the printable substance P and on the transparent polyester. In other embodiments still, a substance may be provided on one side of the panel 113A (e.g., the side of the panel 113A that faces the form back side 100B) and the variable indicia V may be printed on the other side of the panel 113A (specifically, on the exposed portion 113A' thereof) through the void 118 from the form front side 100F. In all embodiments though, the wristband 102 itself may only comprise a single ply and may have no paper. That is, the variable indicia V may be printed directly on the polyester of the wristband 102 or indirectly on the polyester via the use of the printable substance P.

The wristband 102 may be secured around an appendage of the wearer, e.g., around the wrist or forearm. The tip 114T of the wristband 102 may include adhesive A (FIG. 7), and a securement area 120 of the protruding portion 116 (and, in embodiments, only the securement area 120 of the protruding portion 116) may likewise include adhesive A. The securement area 120 may be generally rectangular as shown or take on other symmetrical or nonsymmetrical shapes. The strap 114 may be wrapped around the wearer's wrist and the tip 114T may be adhesively secured to the securement area 120 of the protruding portion 116 to secure the wristband 102 to the wearer. Adhesive A on each of the tip 114T and the securement area 120 (as opposed to only on one of the tip 114T and the securement area 120) may ensure the wristband 102 does not inadvertently come loose after it is secured to the wearer. In use, the wristband may be secured around the wrist such that the variable indicia V faces away from the wrist of the wearer and is easily accessible by the user and others. In an embodiment, when the wristband 102 is so secured, the strap tip 104T secured to the rounded tab 116 is inwardly adjacent the rounded tab 116 (i.e., the strap tip 104T is between the rounded tab 116 and the user's wrist).

The finished wristband 102 secured to the wearer, thus, is of unitary construction and is devoid of paper. As noted, the prior art wristbands typically include paper and polyester and the variable indicia is printed on the paper of the wristband. An added paper layer in the wristband may undesirably add to the thickness of the wristband, make the wristband uncomfortable to wear, make the wristband more prone to tearing or other damage (e.g., water damage), and/or increase manufacturing costs. Elimination of the paper layer from the wristband may address these and other concerns.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations. Not all steps listed in the various figures need be carried out in the specific order described.

The invention claimed is:

1. A combination wristband and label form, comprising:
a front side formed of paper, said front side comprising:
a first portion having a plurality of labels die cut therein; and
a second portion having a void;
a back side comprising a polyester section; and
a single-ply wristband defined by die cuts in said polyester section, said single-ply wristband having a foldable portion comprising a first panel and a second panel, said first panel configured to accept printed indicia, a strap extending laterally from said first panel in a first direction and a rounded tab extending from said second panel in a second direction opposite to said first direction, said rounded tab configured to be adhesively adhered to said strap to secure said single-ply wristband around a person's appendage;
wherein:
said single-ply wristband is removably secured to said combination wristband and label form to allow for said indicia to be printed by a printer on said first panel through said void;
upon folding of said foldable portion, said indicia is sandwiched between said first panel and said second panel; and
said single-ply wristband is of unitary construction and is devoid of paper.

2. The combination wristband and label form of claim 1, wherein said first panel comprises a printable coating configured to accept indicia.

3. The combination wristband and label form of claim 2, wherein said printable coating is ink.

4. The combination wristband and label form of claim 1, further comprising a rectangular securement area on said rounded tab.

5. The combination wristband and label form of claim 1, wherein said void is rectangular.

6. The combination wristband and label form of claim 1, wherein a perimeter of said second panel includes a printed coating.

7. The combination wristband and label form of claim 1, wherein upon securement of said single-ply wristband around said person's appendage, an end of said strap lies between said appendage and said rounded tab.

8. A combination wristband and label form, comprising:
a front side formed of paper, said front side comprising:
a first portion having a plurality of labels die cut therein; and
a second portion having a void;
a back side comprising a polyester section; and
a single-ply wristband defined by die cuts in said polyester section, said single-ply wristband having a foldable portion comprising a first panel and a second panel, said first panel configured to accept printed indicia, a strap extending laterally from one of said first panel and said second panel in a first direction and a rounded tab extending from the other of said first panel and said second panel in a second direction, said rounded tab configured to be adhesively adhered to said strap to secure said single-ply wristband around a person's appendage;
wherein:
said single-ply wristband is removably secured to said combination wristband and label form to allow for said indicia to be printed by a printer on said first panel through said void; and
upon folding of said foldable portion, said indicia is sandwiched between said first panel and said second panel.

9. The combination wristband and label form of claim 8, wherein said first panel comprises a printable coating configured to accept indicia.

10. The combination wristband and label form of claim 9, wherein said printable coating is ink.

11. The combination wristband and label form of claim 8, further comprising a securement area on said rounded tab.

12. The combination wristband and label form of claim 8, wherein said void is rectangular.

13. The combination wristband and label form of claim 8, wherein a perimeter of said second panel includes a printed coating.

14. A combination wristband and label form, comprising:
a front side formed of at least one sheet, said front side comprising:
a first portion having a plurality of labels die cut therein; and
a second portion having a void;
a back side comprising a polyester section and a liner area; and
a single-ply wristband defined by die cuts in said polyester section, said single-ply wristband having a foldable portion comprising a first panel and a second panel, said first panel configured to accept printed indicia, a strap extending laterally from said first panel in a first direction and a tab extending from said second panel in a second direction opposite to said first direction, said tab configured to be adhesively adhered to said strap to secure said single-ply wristband around a person's appendage;
wherein:
said single-ply wristband is removably secured to said combination wristband and label form to allow for said indicia to be printed by a printer on said first panel through said void; and upon folding of said foldable portion, said indicia is sandwiched between said first panel and said second panel.

15. The combination wristband and label form of claim 14, wherein said first panel comprises a printable coating configured to accept indicia.

16. The combination wristband and label form of claim 14, wherein said strap is tapered.

17. The combination wristband and label form of claim 14, wherein a central portion of said strap is devoid of adhesive.

18. The combination wristband and label form of claim 14, wherein said void extends through said combination wristband and label form after said single-ply wristband is removed therefrom.

* * * * *